US011626078B2

(12) United States Patent
Yang et al.

(10) Patent No.: US 11,626,078 B2
(45) Date of Patent: Apr. 11, 2023

(54) DETECTION CIRCUIT AND DRIVING METHOD THEREOF, DRIVING CIRCUIT, DRIVING APPARATUS AND DISPLAY APPARATUS

(71) Applicant: BOE Technology Group Co., Ltd., Beijing (CN)

(72) Inventors: Fei Yang, Beijing (CN); Yi Chen, Beijing (CN); Lirong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 178 days.

(21) Appl. No.: 16/955,986

(22) PCT Filed: Aug. 27, 2019

(86) PCT No.: PCT/CN2019/102908

§ 371 (c)(1),
(2) Date: Jun. 19, 2020

(87) PCT Pub. No.: WO2021/035554

PCT Pub. Date: Mar. 4, 2021

(65) Prior Publication Data

US 2022/0139328 A1 May 5, 2022

(51) Int. Cl.
*G09G 3/3275* (2016.01)

(52) U.S. Cl.
CPC ... *G09G 3/3275* (2013.01); *G09G 2300/0842* (2013.01); *G09G 2310/061* (2013.01); *G09G 2310/08* (2013.01); *G09G 2320/029* (2013.01)

(58) Field of Classification Search
CPC .. G09G 3/3258; G09G 3/3266; G09G 3/3275; G09G 3/3233; G09G 3/2074;
(Continued)

(56) References Cited

U.S. PATENT DOCUMENTS

2014/0176525 A1 6/2014 Woo et al.
2016/0189625 A1 6/2016 Kim et al.
(Continued)

FOREIGN PATENT DOCUMENTS

CN 103886831 A 6/2014
CN 105741761 A 7/2016
(Continued)

OTHER PUBLICATIONS

China National Intellectual Property Administration, First office action of Chinese application No. 201980001492.7 dated Apr. 29, 2022, which is foreign counterpart application of this US application.

*Primary Examiner* — Nitin Patel
*Assistant Examiner* — Amen W Bogale
(74) *Attorney, Agent, or Firm* — Lippes Mathias LLP

(57) ABSTRACT

The present disclosure provides a detection circuit (10) and a driving method, a driving circuit (20), a driving apparatus (100) and a display apparatus. The detection circuit (10) comprises a switching sub-circuit (101) and an analog-to-digital conversion sub-circuit (102). The switching sub-circuit (101) may control on-off states between a sense line (SL) and a reference power terminal (VF), a reset power terminal (RST) and the analog-to-digital conversion sub-circuit (102) according to control signals provided by the external compensation circuit (01). Wherein, a sense signal may include pixel characteristic values or may be a reference power signal.

17 Claims, 9 Drawing Sheets

(58) Field of Classification Search
CPC ..... G09G 3/006; G09G 3/0426; G09G 3/30; G09G 3/3291; G09G 3/3225; G09G 3/3208; G09G 3/3283; G09G 2300/0809; G09G 2300/0861; G09G 2300/0819; G09G 2300/043; G09G 2300/08; G09G 2300/0842; G09G 2300/0426; G09G 2300/0866; G09G 2300/0439; G09G 2310/08; G09G 2310/0248; G09G 2310/0251; G09G 2310/0262; G09G 2310/0264; G09G 2310/0272; G09G 2310/027; G09G 2310/0291; G09G 2310/061; G09G 2320/045; G09G 2320/043; G09G 2320/029; G09G 2320/0295; G09G 2320/0252; G09G 2320/0693; G09G 2320/0233; G09G 2320/0285; G09G 2320/02; G09G 2320/048; G09G 2320/046; G09G 2320/0276; G09G 2320/0223; G09G 2320/041; G09G 2330/12; G09G 2330/028; G09G 2330/08; G09G 2360/16; G09G 3/32; G09G 2300/0847; G09G 2310/0232; G09G 2310/067; G09G 2320/0204; G09G 2320/04; G09G 2320/0257; G02F 1/1309; G01R 31/2635
See application file for complete search history.

(56) References Cited

U.S. PATENT DOCUMENTS

| | | | | |
|---|---|---|---|---|
| 2018/0053462 | A1* | 2/2018 | Bae | G09G 3/2074 |
| 2018/0254004 | A1* | 9/2018 | Hsiao | G09G 3/20 |
| 2019/0325822 | A1 | 10/2019 | Li | |
| 2020/0160781 | A1* | 5/2020 | Park | G09G 3/3275 |
| 2020/0184867 | A1* | 6/2020 | Choi | G09G 3/006 |
| 2020/0211458 | A1 | 7/2020 | He et al. | |
| 2020/0327855 | A1 | 10/2020 | Lin et al. | |
| 2020/0372861 | A1* | 11/2020 | Ok | G09G 3/3233 |

FOREIGN PATENT DOCUMENTS

| | | | |
|---|---|---|---|
| CN | 106935192 | A | 7/2017 |
| CN | 108615505 | A | 10/2018 |
| CN | 108877650 | A | 11/2018 |
| CN | 109377943 | A | 2/2019 |

* cited by examiner

DETECTION CIRCUIT AND DRIVING METHOD THEREOF, DRIVING CIRCUIT, DRIVING APPARATUS AND DISPLAY APPARATUS

This application is a 371 of PCT Application No. PCT/CN2019/102908 filed on Aug. 27, 2019, the entire contents of which are incorporated herein by reference.

TECHNICAL FIELD

The present disclosure relates to the field of a display technology, and particularly, to a detection circuit and a driving method thereof, a driving circuit, a driving apparatus and a display apparatus.

BACKGROUND

Organic light emitting diodes (OLED) are widely used in display panels because of its advantages of wide color gamut, wide viewing angle, low energy consumption, high contrast and the like. An OLED display panel generally includes a plurality of pixel units, wherein each pixel unit may include a pixel circuit and a light emitting element connected to the pixel circuit. Each pixel circuit may output a data signal to the light emitting element to which it is connected to drive the light emitting element to emit light.

In related arts, in order to avoid a relatively poor light emitting effect of the light emitting elements caused by the aging of the light emitting elements or transistors in the pixel circuits, the data signals may be compensated in a manner of external compensation. The method of external compensation may include: a detection circuit acquires characteristic parameters (e.g., a threshold voltage) of the transistors through sense lines; an analog-to-digital converter converts the characteristic parameters into digital signals and outputs them to an external compensation circuit; and the external compensation circuit compensates data signals according to the received characteristic parameters.

SUMMARY

The present disclosure provides a detection circuit and a driving method, a driving circuit, a driving apparatus and a display apparatus.

In an aspect, there is provided a detection circuit, comprising a switching sub-circuit and an analog-to-digital conversion sub-circuit, wherein the switching sub-circuit is connected to a sense line, an external compensation circuit, a reference power terminal, a reset power terminal, and the analog-to-digital conversion sub-circuit, respectively; the switching sub-circuit is used to control an on-off state between the sense line and the reference power terminal in response to a first control signal provided by the external compensation circuit, used to control an on-off state between the sense line and the reset power terminal in response to a second control signal provided by the external compensation circuit, and used to control an on-off state between the sense line and the analog-to-digital conversion sub-circuit in response to a third control signal provided by the external compensation circuit; and the analog-to-digital conversion sub-circuit is also connected to the external compensation circuit, and used to convert a sense signal from the sense line into a digital signal when the analog-to-digital conversion sub-circuit is in conduction with the sense line and then output the digital signal to the external compensation circuit, such that the external compensation circuit compensates a data signal according to the sense signal.

Optionally, the switching sub-circuit includes a first switch assembly, a second switch assembly, and a third switch assembly;

the first switch assembly is connected to the external compensation circuit, the sense line and the reference power terminal, respectively, and used to control the on-off state between the sense line and the reference power terminal in response to the first control signal;

the second switch assembly is connected to the external compensation circuit, the sense line and the reset power terminal, respectively, and used to control the on-off state between the sense line and the reset power terminal in response to the second control signal; and the third switch assembly is connected to the external compensation circuit, the sense line and the analog-to-digital conversion sub-circuit, respectively, and used to control the on-off state between the sense line and the analog-to-digital conversion sub-circuit in response to the third control signal.

Optionally, the first switch assembly includes a first switch, the second switch assembly includes a second switch, and the third switch assembly include a third switch;

a control end of the first switch is connected to the external compensation circuit, a first end of the first switch is connected to the reference power terminal, and a second end of the first switch is connected to the sense line;

a control end of the second switch is connected to the external compensation circuit, a first end of the second switch is connected to the reset power terminal, and a second end of the second switch is connected to the sense line;

a control end of the third switch is connected to the external compensation circuit, a first end of the third switch is connected to the analog-to-digital conversion sub-circuit, and a second end of the third switch is connected to the sense line.

Optionally, the reference power terminal includes a first sub reference power terminal and a second sub reference power terminal; a potential of a reference power signal provided by the first sub reference power terminal is different from a potential of a reference power signal provided by the second sub reference power terminal; the first switch assembly includes two of the first switches;

a first end of one of two of the first switches is connected to the first sub reference power terminal, and a first end of the other first switch is connected to the second sub reference power terminal.

Optionally, the analog-to-digital conversion sub-circuit includes an analog-to-digital converter;

one end of the analog-to-digital converter is connected to the switching sub-circuit, and the other end of the analog-to-digital converter is connected to the external compensation circuit.

Optionally, the detection circuit further includes a storage sub-circuit;

the storage sub-circuit is connected to the reset power terminal, the switching sub-circuit and the analog-to-digital conversion sub-circuit respectively, and used to store a sense signal output from the sense line to the analog-to-digital conversion sub-circuit through the switching sub-circuit when the sense line is in conduction with the analog-to-digital conversion sub-circuit.

Optionally, the storage sub-circuit includes a storage capacitor;

one end of the storage capacitor is connected to the switching sub-circuit and the analog-to-digital conversion sub-circuit, and the other end of the storage capacitor is connected to the reset power terminal.

Optionally, the switching sub-circuit includes one of the first switch, one of the second switch and one of the third switch;

the analog-to-digital conversion sub-circuit includes an analog-to-digital converter, wherein one end of the analog-to-digital converter is connected to the switching sub-circuit, and the other end of the analog-to-digital converter is connected to the external compensation circuit.

the detection circuit further includes a storage capacitor, wherein one end of the storage capacitor is connected to the switching sub-circuit and the analog-to-digital conversion sub-circuit, and the other end of the storage capacitor is connected to the reset power terminal.

In another aspect, there is provided a driving method for a detection circuit, which is used to drive the detection circuit as described in the above aspect, and the method includes:

in a charging phase, in which a potential of the first control signal provided by the external compensation circuit is a first potential, the switching sub-circuit controls the sense line to be in conduction with the reference power terminal in response to the first control signal;

in a resetting phase, in which a potential of the second control signal provided by the external compensation circuit is a first potential, the switching sub-circuit controls the sense line to be in conduction with the reset power terminal in response to the second control signal;

in a signal acquisition phase, in which the potential of the first control signal, the potential of the second control signal, and a potential of the third control signal provided by the external compensation circuit are all second potentials, the switching sub-circuit controls the sense line to be disconnected with the reference power terminal in response to the first control signal, controls the sense line to be disconnected with the reset power terminal in response to the second control signal, and controls the sense line to be disconnected with the analog-to-digital conversion sub-circuit in response to the third control signal; and in a signal output phase, in which the potential of the third control signal is a first potential; the switching sub-circuit controls the sense line to be conducted with the analog-to-digital conversion sub-circuit in response to the third control signal, the analog-to-digital conversion sub-circuit converts a sense signal from the sense line into a digital signal and outputs the digital signal to the external compensation circuit, such that the external compensation circuit compensates a data signal according to the sense signal.

Optionally, the switching sub-circuit includes a first switch, a second switch, a third switch, and a storage capacitor; the analog-to-digital conversion sub-circuit includes an analog-to-digital converter;

in the charging phase, the potential of the second control signal and the potential of the third control signal are both second potentials, the first switch is turned on, and the second switch and the third switch are turned off; the reference power terminal outputs a reference power signal from the reference power terminal to the sense line through the first switch;

in the resetting phase, the potential of the first control signal and the potential of the third control signal are both second potentials, the second switch is turned on, and the first switch and the third switch are turned off; the reset power terminal outputs a reset power signal from the reset power terminal to the sense line through the second switch;

in the signal acquisition phase, the first switch, the second switch and the third switch are all turned off; the sense line is disconnected with the reference power terminal, the reset power terminal, and the analog-to-digital conversion sub-circuit; the sense line acquires a sense signal from each pixel unit to which it is connected;

in the signal output phase, the potential of the first control signal and the potential of the second control signal are both second potentials; the third switch is turned on, and the first switch and the second switch are both turned off; the sense line outputs the sense signal to the analog-to-digital converter through the third switch; and the storage capacitor stores the sense signal.

In yet another aspect, there is provided a source driving circuit comprising any of the detection circuits described in the above aspect.

Optionally, the source driving circuit includes: at least two of the plurality of detection circuits multiplex one analog-to-digital conversion sub-circuit.

In still another aspect, there is provided a driving apparatus for a display panel, the driving apparatus comprising an external compensation circuit, and the source driving circuit as described in the above aspect connected to the external compensation circuit;

the source driving circuit is used to output a sense signal acquired by a sense line to the external compensation circuit;

the external compensation circuit is used to compensate a data signal according to the sense signal, and output the compensated data signal to the source driving circuit; and the source driving circuit is further used to output the compensated data signal to a pixel unit through a data line.

Optionally, the driving apparatus includes a plurality of the source driving circuits, and data lines and sense lines, which are connected to the respective source driving circuits, are different, respectively.

Optionally, the driving apparatus further includes a first storage circuit and a second storage circuit which are connected to the external compensation circuit respectively;

the first storage circuit is used to provide a data signal to the external compensation circuit, and the second storage circuit is used to provide a pixel compensation value to the external compensation circuit; and the external compensation circuit is used to compensate the data signal according to the pixel compensation value and the sense signal.

In a still another aspect, there is provided a display apparatus, the display apparatus comprising a display panel, and the driving apparatus for the display panel as described in the above aspect, wherein a source driving circuit in the driving apparatus is connected to a pixel unit in the display panel through a data line and a sense line.

Optionally, the display panel includes a plurality of pixel units which is arranged in an array; and the pixel units located in the same column are connected to one data line and one sense line, and the data lines and the sense lines, which are connected to the pixel units located in different columns are different, respectively.

Optionally, each of the pixel units includes a pixel circuit, and a light emitting element connected to the pixel circuit; and each sense line is connected to corresponding pixel circuits and a corresponding detection circuit in the source driving circuit, respectively.

DETAILED DESCRIPTION

For clearer descriptions of the objects, technical solutions and advantages of the present disclosure, the present disclosure is described in detail below in combination with the accompanying drawings.

Transistors used in all the embodiments of the present disclosure may be thin film transistors or field effect transistors or other devices with the same characteristics. The transistors employed in the embodiments of the present disclosure are mainly switching transistors according to their roles in a circuit. Since a source electrode and a drain electrode of a switching transistor used here are symmetrical, and are thus interchangeable. In an embodiment of the present disclosure, the source electrode is referred to as a first pole, the drain electrode is referred to as a second pole; or the drain electrode is referred to as the first pole, and the source electrode is referred to as the second pole. According to the forms in the accompanying drawings, it is stipulated that an intermediate end of the transistor is a gate electrode, a signal input end is a source electrode, and a signal output end is a drain electrode. Moreover, the switching transistor used in the embodiments of the present disclosure may include any one of a P-type switching transistor and an N-type switching transistor, wherein the P-type switching transistor is turned on when a gate electrode is in a low level, and turned off when the gate electrode is in a high level; and the N-type switching transistor is turned on when a gate electrode is in a high level, and turned off when the gate electrode is in a low level. Furthermore, a plurality of signals in the embodiments of the present disclosure each correspondingly has a first potential and a second potential, which only represent, that the potential of the signal has two different state quantities, rather than that the first potential or the second potential has a specific value throughout the text.

Figure 1:
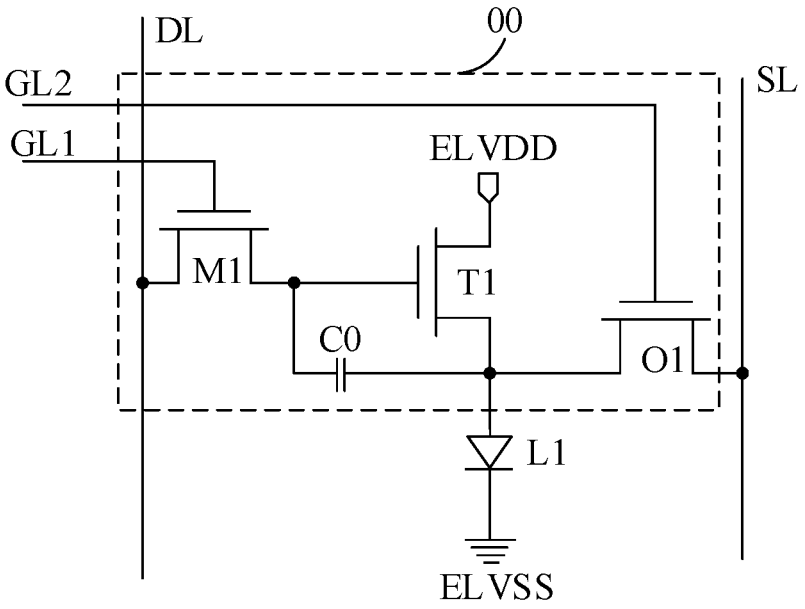
FIG. 1 is a schematic structural diagram of a pixel unit provided by an embodiment of the present disclosure.

FIG. 1 is a schematic structural diagram of a pixel unit provided by an embodiment of the present disclosure. Referring to FIG. 1, the pixel unit may include a pixel circuit 00 and a light emitting element L1. The pixel circuit 00 may include a switching transistor M1, a driving transistor T1, a detection transistor O1, and a storage capacitor C0.

A gate electrode of the switching transistor M1 may be connected to a gate line (GL) GL1, a first pole of the switching transistor M1 may be connected to a data line (DL), and a second pole of the switching transistor M1 may be connected to a gate electrode of the driving transistor T1. A first pole of the driving transistor T1 may be connected to a DC power terminal ELVDD, a second pole of the driving transistor T1 may be connected to one end of the light emitting element L1, and the other end of the light emitting element L1 may be connected to a DC power terminal ELVSS. One end of the storage capacitor C0 may be connected to the second pole of the driving transistor T1, and the other end of the storage capacitor C0 may be connected to the gate electrode of the driving transistor T1. A gate electrode of the detection transistor O1 may be connected to a gate line GL2, a first pole of the detection transistor O1 may be connected to the second pole of the driving transistor T1, and a second pole of the detection transistor O1 may be connected to a sense line (SL). The sense line SL may also be connected to an external compensation circuit (not shown in FIG. 1).

In embodiments of the present disclosure, the switching transistor M1 may output a data signal from the data line DL to the gate electrode of the driving transistor T1 in response to a gate drive signal provided by the gate line GL1. The storage capacitor C0 may store the data signal. The driving transistor T1 may output a drive signal to the light emitting element L1 in response to the data signal and a DC power signal from the DC power terminal ELVDD to drive the light emitting element L1 to emit light. The detection transistor O1 may output a sense signal from the pixel circuit 00 to the sense line SL in response to a gate drive signal provided by a gate line GL2. This sense signal may include pixel characteristic values such as a threshold voltage and an offset ratio of the driving transistor T1. The sense line SL may output the acquired sense signal to the external compensation circuit, so that the external compensation circuit performs external compensation on a data signal according to the sense signal.

Figure 2:
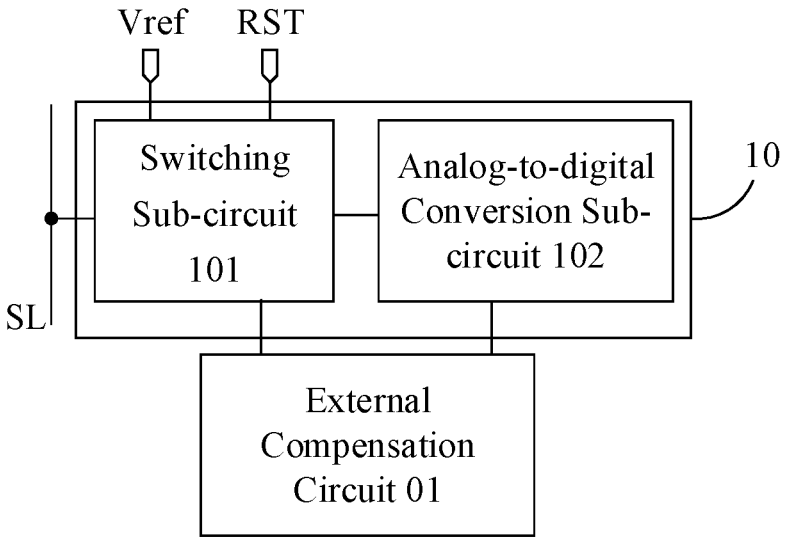
FIG. 2 is a schematic structural diagram of a detection circuit provided by an embodiment of the present disclosure.

FIG. 2 is a schematic structural diagram of a detection circuit provided by an embodiment of the present disclosure. As shown in FIG. 2, the detection circuit 10 may include a switching sub-circuit 101 and an analog-to-digital conversion sub-circuit 102.

The switch sub-circuit 101 may be connected to the sense line SL, the external compensation circuit 01, a reference power terminal Vref, a reset power terminal RST, and an analog-to-digital conversion sub-circuit 102, respectively. The switching sub-circuit 101 may control an on-off state between the sense line SL and the reference power terminal Vref in response to a first control signal provided by the external compensation circuit 01; may control an on-off state between the sense line SL and the reset power terminal RST in response to a second control signal provided by the external compensation circuit 01; and may control an on-off state between the sense line SL and the analog-to-digital conversion sub-circuit 102 in response to a third control signal provided by the external compensation circuit 01.

The analog-to-digital conversion sub-circuit 102 may also be connected to the external compensation circuit 01. The analog-to-digital conversion sub-circuit 102 may convert a sense signal from the sense line SL into a digital signal and then output the digital signal to the external compensation circuit 01 when the analog-to-digital conversion sub-circuit 102 is in conduction with the sense line SL, so that the external compensation circuit 01 compensates a data signal according to the sense signal.

Exemplarily, the switching sub-circuit 101 may control the sense line SL to be in conduction with the reference power terminal Vref when a potential of the first control signal provided by the external compensation circuit 01 is a first potential. In this case, the reference power terminal Vref may output a reference power signal to the sense line SL through the switching sub-circuit 101, to charge the sense line SL, thereby achieving a charging function for the sense line SL. The potential of the reference power signal may be a fixed potential.

The switching sub-circuit 101 may control the sense line SL to be in conduction with the reset power terminal Vref when a potential of the second control signal provided by the external compensation circuit 01 is a first potential. In this case, the reset power terminal RST may output a reset power signal to the sense line SL through the switching sub-circuit 101, to reset the sense line SL, thereby achieving a reset function for the sense line SL.

The switching sub-circuit 101 may control the sense line SL to be in conduction with the analog-to-digital conversion sub-circuit 102 when a potential of the third control signal provided by the external compensation circuit 01 is a first potential. In this case, the sense line SL may output a sense signal to the analog-to-digital conversion sub-circuit 102 through the switching sub-circuit 101, thereby achieving an analog-to-digital conversion function for the sense signal. The analog-to-digital conversion sub-circuit 102 may convert the sense signal into a digital signal and then output the digital signal to the external compensation circuit 01, so that the external compensation circuit 01 reliably compensates a data signal according to the sense signal. The sense signal may include pixel characteristic values of a pixel unit.

The switch sub-circuit 101 may also control the sense line SL to be disconnected with the reference power terminal Vref, the reset power terminal RST and the analog-to-digital conversion sub-circuit 102 when the potential of the first control signal, the potential of the second control signal and the potential of the third control signal are all second potentials, thereby floating the sense line SL, i.e., achieving a floating function for the sense line SL.

In this case, under the control of the pixel unit, a current will flow through the sense line SL, so that the potential on the sense line SL rises, Since the pixel characteristic values of the pixel unit may change at different times, the potential on this sense line SL can reflect the changes in the pixel characteristic values, such that the external compensation circuit reliably compensates the data signal according to the sense signal from the sense line SL, thereby avoiding the problem of a relatively poor display effect caused by the changes in pixel characteristic values (such as the aging of a driving transistor).

It should be noted that, in embodiments of the present disclosure, the first potential may be a valid potential, the second potential may be an invalid potential, and the first potential may be a high potential relative to the second potential.

It should also be noted that when the switching sub-circuit 101 first controls the sense line SL to be in conduction with the reference power terminal Vref, and then directly controls the sense line SL to be in conduction with the analog-to-digital conversion sub-circuit 102, the sense line SL may output a reference power signal as the sense signal to the analog-to-digital conversion sub-circuit 102, and the analog-to-digital conversion sub-circuit 102 may then convert the sense signal into a digital signal and output the digital signal to the external compensation circuit 01. Since the potential of the reference power signal is a fixed potential, the external compensation circuit 01 may determine a conversion performance of the analog-to-digital conversion sub-circuit 102 according to a conversion result of the analog-to-digital conversion sub-circuit 102 to convert the reference power signal into the digital signal. Furthermore, the external compensation circuit 01 may reliably compensate the data signal according to the conversion performance of the analog-to-digital conversion sub-circuit 102, which may also be referred to as a correction function (i.e., ADC correction function) of the external compensation circuit 01 to the analog-to-digital conversion sub-circuit 102.

The charging function, the reset function and the floating function for the sense line SL, as well as the analog-to-digital conversion function for the sense signal can be achieved in sequence when the switching sub-circuit 101 first controls the sense line SL to be in conduction with the reference power terminal Vref, then controls the sense line SL to be in conduction with the reset power terminal RST, next controls the sense line SL to be disconnected with the reference power terminal Vref, the reset power terminal RST and the analog-to-digital conversion sub-circuit 102, and controls the sense line SL to be in conduction with the analog-to-digital conversion sub-circuits 102 at last. Furthermore, the function of acquiring the sense signal of the pixel unit to which the sense line SL is connected can be achieved, so that the external compensation circuit 01 can reliably compensate the data signal according to the sense signal acquired by the sense line SL.

The detection circuit 10 can achieve the charging, reset and floating functions for the sense line SL, and the analog-to-digital conversion function for the sense signal. Therefore, under the control of the external compensation circuit 01, the detection circuit 10 may provide the external compensation circuit 01 with a signal for correcting the analog-to-digital conversion sub-circuit 102 and with a signal for performing external compensation on the pixel characteristic values of the pixel unit. The detection circuit has relatively rich functions, meets the requirements of external compensation for most functions of the detection circuit, further improves the compensation effect and ensures the display quality.

In summary, embodiments of the present disclosure provides a detection circuit. The detection circuit includes the switching sub-circuit and the analog-to-digital conversion sub-circuit. Since the switch sub-circuit may control the on-off states between the sense line SL and the reference power terminal, the reset power terminal and the analog-to-digital conversion sub-circuit according to the control signals provided by the external compensation circuit, the detection circuit has relatively rich functions.

When the switching sub-circuit sequentially controls the sense line and the reference power terminal as well as the sense line to be in conduction with the analog-to-digital conversion sub-circuit, the sense line may output a reference power signal to the analog-to-digital conversion sub-circuit through the switching sub-circuit, and correspondingly, the sense signal received by the analog-to-digital conversion sub-circuit may be the reference power signal. In this case, after the analog-to-digital conversion sub-circuit converts the sense signal into a digital signal and outputs the digital signal to the external compensation circuit, the external compensation circuit determines a conversion performance of the analog-to-digital conversion sub-circuit according to the conversion result, and reliably compensates the data signal according to the conversion performance, thereby achieving reliable compensation for the conversion performance of the analog-to-digital conversion sub-circuit.

When the switching sub-circuit sequentially controls the sense line and the reference power terminal, the reset power terminal to be in conduction with the analog-to-digital conversion sub-circuit, the sense line may output the pixel characteristic values to the analog-to-digital conversion sub-circuit through the switching sub-circuit, and correspondingly, the sense signal received by the analog-to-digital conversion sub-circuit may include the pixel characteristic values. In this case, after the analog-to-digital conversion sub-circuit converts the sense signal into a digital signal and then output the digital signal to the external compensation circuit, the external compensation circuit reliably compensates a data signal output to the pixel unit according to the received sense signal, thereby achieving reliable compensation of the pixel characteristic values. The detection circuit has relatively rich functions and ensures that the external compensation circuit has a relatively high compensation accuracy.

Figure 3:
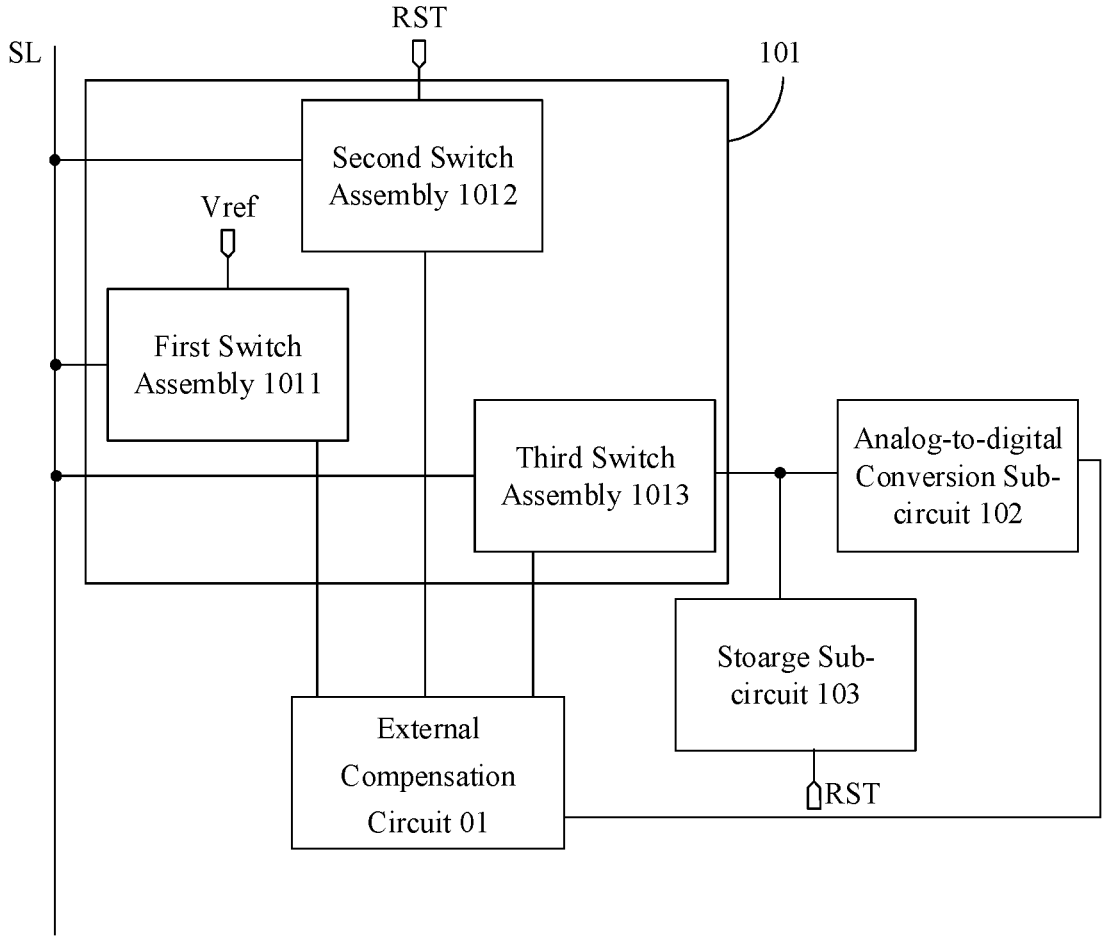
FIG. 3 is a schematic structural diagram of another detection circuit provided by an embodiment of the present disclosure.

FIG. 3 is a schematic structural diagram of another detection circuit provided by an embodiment of the present disclosure. As shown in FIG. 3, the switch sub-circuit 101 may include a first switch assembly 1011, a second switch assembly 1012, and a third switch assembly 1013.

Referring to FIG. 3, the first switch assembly 1011 may be connected to the external compensation circuit 01, the sense line SL, and the reference power terminal Vref, respectively. The first switch assembly 1011 may control an on-off state between the sense line SL and the reference power terminal Vref in response to a first control signal.

Exemplarily, the switching sub-circuit 1011 may control the sense line SL to be in conduction with the reference power terminal Vref when a potential of the first control signal is a first potential, such that the reference power terminal Vref outputs a reference power signal to the sense line SL through the first switch assembly 1011 to charge the sense line SL. In addition, the first switch assembly 1011 may control the sense line SL to be disconnected with the reference power terminal Vref when the potential of the first control signal is a second potential.

The second switch assembly 1012 may be connected to the external compensation circuit 01, the sense line SL, and a reset power terminal RST, respectively. The second switch assembly 1012 may control an on-off state between the sense line SL and the reset power terminal RST in response to a second control signal.

Exemplarily, the second switch assembly 1012 may control the sense line SL to be in conduction with the reset power terminal RST when a potential of the second control signal is a first potential, such that the reset power terminal RST outputs a reset power signal to the sense line SL through the second switch assembly 1012 to reset the sense line SL, thereby making a charging potential for the sense line SL more stable and ensuring the display quality. In addition, the second switch assembly 1012 may control the sense line SL to be disconnected with the reset power terminal Vref when the potential of the second control signal is the second potential.

Optionally, in embodiments of the present disclosure, the reset power terminal RST may be a ground terminal. Of course, the reset power terminal RST may also be a power signal terminal capable of providing a power signal of the second potential.

The third switch assembly 1013 may be connected to the external compensation circuit 01, the sense line SL, and the analog-to-digital conversion sub-circuit 102, respectively. The third switch assembly 1013 may control an on-off state between the sense line SL and the analog-to-digital conversion sub-circuit 102 in response to a third control signal.

Exemplarily, the third switch assembly 1013 may control the sense line SL to be in conduction with the analog-to-digital conversion sub-circuit 102 when a potential of the third control signal is a first potential, such that the sense line SL outputs a sense signal to the analog-to-digital conversion sub-circuit 102 through the third switch assembly 1013, the analog-to-digital conversion sub-circuit 102 further converts the sense signal into a digital signal and outputs the digital signal to the external compensation circuit 01, and the external compensation circuit 01 reliably compensates the data signal according to the received sense signal. In addition, the third switch assembly 1013 may control the sense line SL to be disconnected with the analog-to-digital conversion sub-circuit 102 when the potential of the third control signal is the second potential.

Optionally, referring to FIG. 3, the detection circuit 10 may further include a storage sub-circuit 103. The storage sub-circuit 103 may be connected to the switching sub-circuit 101, the analog-to-digital conversion sub-circuit 102, and the reset power terminal RST, respectively. The storage sub-circuit 103 may store the sense signal output by the sense line SL to the analog-to-digital conversion sub-circuit 102 through the switching sub-circuit 101 when the sense line SL is in conduction with the analog-to-digital conversion sub-circuit 102.

By providing the storage sub-circuit 103 to store the sense signal, a potential of the sense signal can be kept stable, and thus the sense signal can be reliably output to the analog-to-digital conversion sub-circuit 102.

Figure 4:
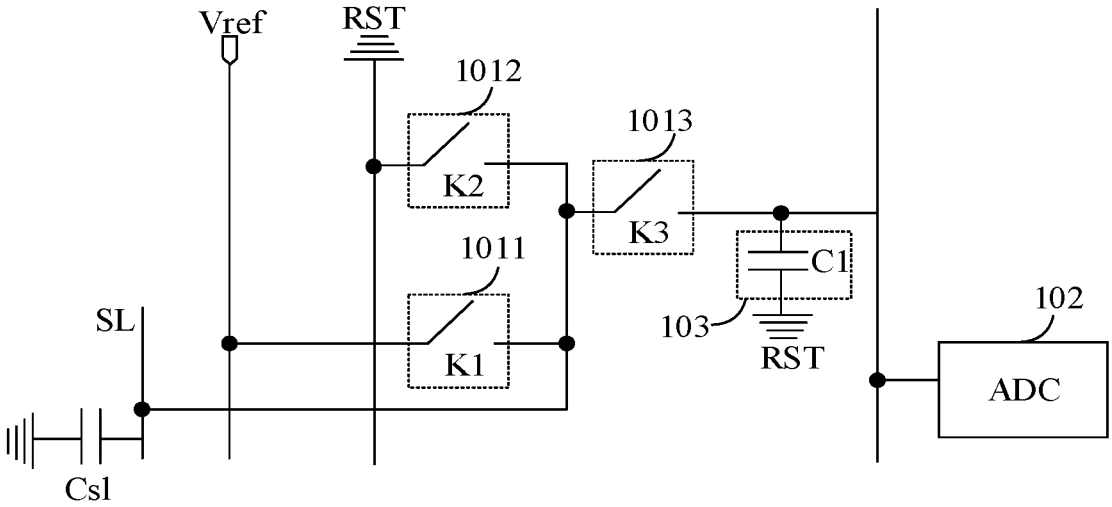
FIG. 4 is a schematic structural diagram of yet another detection circuit provided by an embodiment of the present disclosure.

FIG. 4 is a schematic structural diagram of still another detection circuit provided by an embodiment of the present disclosure. As shown in FIG. 4, the first switch assembly 1011 may include a first switch K1. The second switch assembly 1012 may include a second switch K2. The third switch assembly 1013 may include a third switch K3.

A control end of the first switch K1 may be connected to the external compensation circuit (not shown in FIG. 4), a first end of the first switch K1 may be connected to the reference power terminal Vref, and a second end of the first switch K1 may be connected to the sense line SL.

A control end of the second switch K2 may be connected to the external compensation circuit (not shown in FIG. 4), a first end of the second switch K2 may be connected to the reset power terminal RST, and a second end of the second switch K2 may be connected to the sense line SL.

A control end of the third switch K3 may be connected to the external compensation circuit (not shown in FIG. 4), a first end of the third switch K3 may be connected to the analog-to-digital conversion sub-circuit 102, and a second end of the third switch K3 may be connected to the sense line SL.

Figure 5:
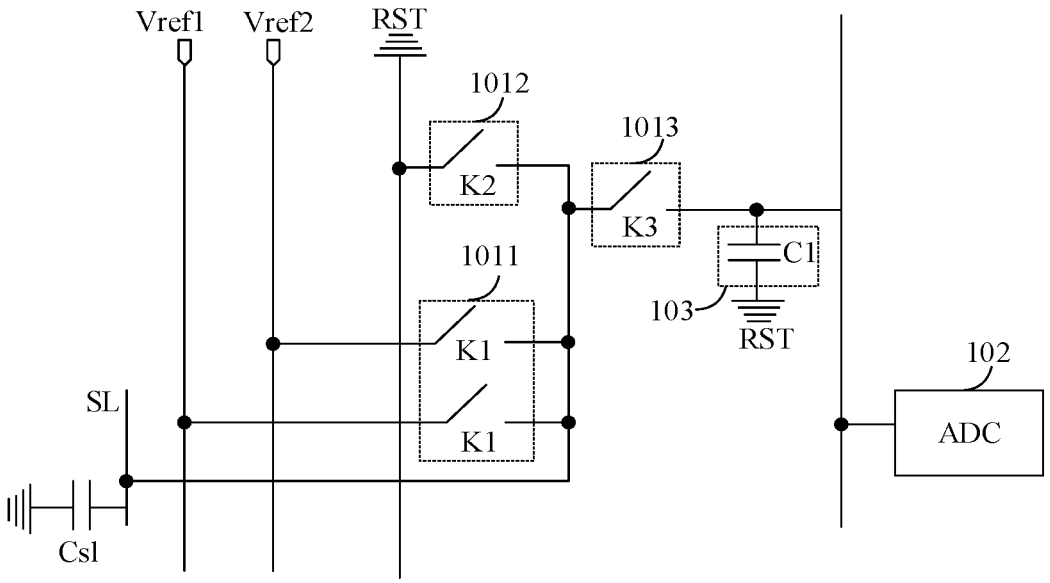
FIG. 5 is a schematic structural diagram of still another detection circuit provided by an embodiment of the present disclosure.

FIG. 5 is a schematic structural diagram of still another detection circuit provided by an embodiment of the present disclosure. As shown in FIG. 5, the reference power terminal Vref may include a first sub reference power terminal Vref1 and a second sub reference power terminal Vref2. Correspondingly, the first switch assembly 1011 may include two first switches K1.

In two of the first switches K1 included in the first switch assembly 1011, a first end of one first switch K1 may be connected to the first sub reference power terminal Vref1, and a first end of the other first switch K1 may be connected to the second sub reference power terminal Vref2.

A potential of a reference power signal provided by the first sub reference power terminal Vref1 may be different from a potential of a reference power signal provided by the second sub reference power terminal Vref2. For example, the potential of the reference power signal provided by the first sub reference power terminal Vref1 is 1V, and the potential of the reference power signal provided by the second sub reference power terminal Vref2 is 2V.

Of course, the potential of the reference power signal provided by the first sub reference power terminal Vref1 may be the same as the potential of the reference power signal provided by the second sub reference power terminal Vref2. For example, the potential of the reference power signal provided by the first sub reference power terminal Vref1 and the potential of the reference power signal provided by the second sub reference power terminal Vref2 are both 1V.

Optionally, referring to FIGS. 4 and 5, the analog-to-digital conversion sub-circuit 102 may include an analog-to-digital converter ADC. One end of the analog-to-digital converter ADC may be connected to the switching sub-circuit 101, and the other end of the analog-to-digital converter ADC may be connected to the external compensation circuit 01 (not shown in FIGS. 4 and 5).

Optionally, referring to FIGS. 4 and 5, the storage sub-circuit 103 may include a storage capacitor C1.

One end of the storage capacitor C1 may be connected to the switching sub-circuit 101 and the analog-to-digital conversion sub-circuit 102, and the other end of the storage capacitor C1 may be connected to the reset power terminal RST.

It should be noted that a capacitance value of the storage capacitor C1 may be smaller than a capacitance value of a parasitic capacitor Cs1 of the sense line SL. By setting the capacitance value of the storage capacitor C1 to be relatively small, it can be ensured that a potential of the sense signal output from the sense line SL to the analog-to-digital conversion sub-circuit 102 can remain unchanged.

Optionally, referring to FIG. 4 and FIG. 5, all reset power terminals RST of the detection circuit may be ground terminals.

Optionally, referring to FIG. 4, the switching sub-circuit 101 may include one first switch K1, one second switch K2, and one third switch K3. By providing only one first switch K1, the structure of the detection circuit 10 can be simplified in the case of ensuring the compensation effect.

In summary, embodiments of the present disclosure provides a detection circuit. The detection circuit includes the switching sub-circuit and the analog-to-digital conversion sub-circuit. Since the switch sub-circuit can control the on-off states between the sense line SL and the reference power terminal, the reset power terminal and the analog-to-digital conversion sub-circuit according to the control signals provided by the external compensation circuit, the detection circuit has relatively rich functions.

When the switching sub-circuit sequentially controls the sense line and the reference power terminal as well as the sense line to be in conduction with the analog-to-digital conversion sub-circuit, the sense line may output the reference power signal to the analog-to-digital conversion sub-circuit through the switching sub-circuit, and correspondingly, the sense signal received by the analog-to-digital conversion sub-circuit may be the reference power signal. In this case, after the analog-to-digital conversion sub-circuit converts the sense signal into a digital signal and outputs the digital signal to the external compensation circuit, the external compensation circuit determines a conversion performance of the analog-to-digital conversion sub-circuit according to the conversion result, and reliably compensates the data signal according to the conversion performance, thereby achieving reliable compensation for the conversion performance of the analog-to-digital conversion sub-circuit.

When the switching sub-circuit sequentially controls the sense line and the reference power terminal, the reset power terminal to be in conduction with the analog-to-digital conversion sub-circuit, the sense line may output pixel characteristic values to the analog-to-digital conversion sub-circuit through the switching sub-circuit, and correspondingly, the sense signal received by the analog-to-digital conversion sub-circuit may include the pixel characteristic values. In this case, after the analog-to-digital conversion sub-circuit converts the sense signal into a digital signal and then output the digital signal to the external compensation circuit, the external compensation circuit reliably compensates the data signal output to the pixel unit according to the received sense signal, thereby achieving reliable compensation of the pixel characteristic values. The detection circuit has rich functions and ensures that the external compensation circuit has a relatively high compensation accuracy.

Figure 6:
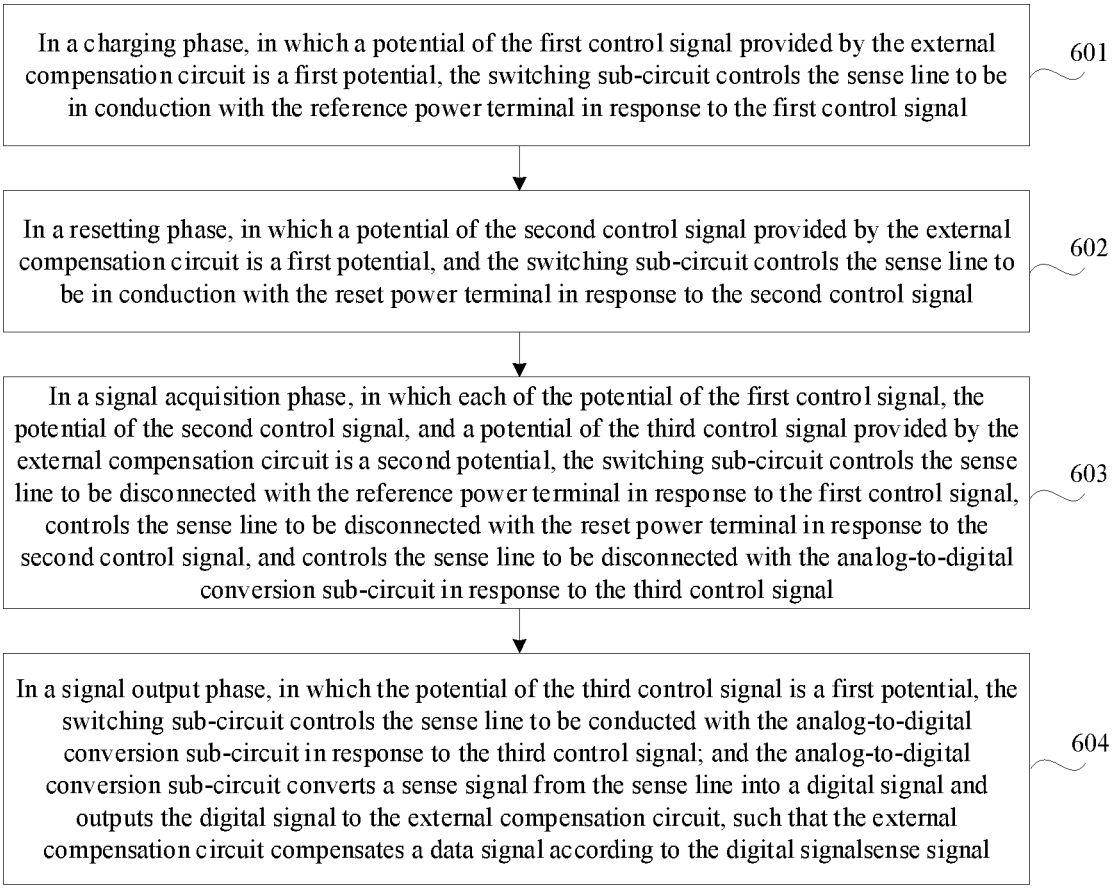
FIG. 6 is a flowchart of a driving method of a detection circuit according to an embodiment of the present disclosure.

FIG. 6 illustrates a driving method of a detection circuit provided by an embodiment of the present disclosure, which is used to drive the detection circuit as shown in any of FIGS. 2 to 5. As shown in FIG. 6, the method may include the following steps.

In step 601, in a charging phase, in which a potential of the first control signal provided by the external compensation circuit is a first potential, the switching sub-circuit controls the sense line to be in conduction with the reference power terminal in response to the first control signal.

Exemplarily, in the charging phase, the potential of the first control signal provided by the external compensation circuit may be a first potential, and the switching sub-circuit may control the sense line to be in conduction with the reference power terminal under the control of the first control signal, such that the reference power terminal outputs a reference power signal to the sense line to charge the sense line, that is, achieving a charging function for the sense line. In addition, in the charging phase, a potential of a second control signal and a potential of the third control signal provided by the external compensation circuit may both be second potentials; and the switching sub-circuit may control the sense line to be disconnected with a reset power terminal under the control of the second control signal, and may control the sense line to be disconnected with an analog-to-digital conversion sub-circuit under the control of the third control signal. It should be noted that, in order to ensure sufficient charging of the sense line, the duration of the charging phase may be relatively long.

In step 602, in a resetting phase, in which the potential of the second control signal provided by the external compensation circuit is a first potential, the switching sub-circuit controls the sense line to be in conduction with the reset power terminal in response to the second control signal.

Exemplarily, in the resetting phase, the potential of the second control signal provided by the external compensation circuit may be the first potential, and the switching sub-circuit may control the sense line to be in conduction with the reference power terminal under the control of the second control signal, such that the reset power terminal outputs a reset power signal to the sense line to reset the sense line, that is, achieving a reset function for the sense line. In addition, in the resetting phase, the potential of the first control signal and the potential of the third control signal provided by the external compensation circuit may both be second potentials; and the switching sub-circuit may control the sense line to be disconnected with the reference power terminal under the control of the first control signal, and may control the sense line to be disconnected with the analog-to-digital conversion sub-circuit under the control of the third control signal.

In step 603, in a signal acquisition phase, in which the potential of the first control signal, the potential of the second control signal, and the potential of the third control signal provided by the external compensation circuit are all second potentials, the switching sub-circuit controls the sense line to be disconnected with the reference power terminal in response to the first control signal, controls the sense line to be disconnected with the reset power terminal in response to the second control signal, and controls the sense line to be disconnected with the analog-to-digital conversion sub-circuit in response to the third control signal.

Exemplarily, in the signal acquisition phase, the potential of the first control signal, the potential of the second control signal, and the potential of the third control signal provided by the external compensation circuit may all be the second potentials. The switching sub-circuit may respectively control the sense line to be disconnected with the reference power terminal, the reset power terminal, and the analog-to-digital conversion sub-circuit under the control of the first control signal, the second control signal, and the third control signal, such that the sense line is not connected to any end of the detection circuit, so as to achieve a floating function for the sense line.

In this case, under the control of the pixel unit, a current will flow through the sense line SL, so that the potential on the sense line SL rises. Since the pixel characteristic values of the pixel unit may change at different times, the potential on this sense line SL can reflect the changes in pixel characteristic values, such that the external compensation circuit reliably compensates a data signal according to the sense signal from the sense line SL, thereby avoiding the problem of a relatively poor display effect caused by the changes in pixel characteristic values (such as the aging of a driving transistor).

In step 604, in a signal output phase, in which the potential of the third control signal is a first potential; the switching sub-circuit controls the sense line to be conducted with the analog-to-digital conversion sub-circuit in response to the third control signal, the analog-to-digital conversion sub-circuit converts a sense signal from the sense line into a digital signal and outputs the digital signal to the external compensation circuit, such that the external compensation circuit compensates a data signal according to the sense signal.

Exemplarily, in the signal output phase, the potential of the third control signal provided by the external compensation circuit may be the first potential, and the switching sub-circuit may control the sense line to be in conduction with the analog-to-digital conversion sub-circuit under the control of the third control signal, such that the sense line outputs a sense signal to the analog-to-digital conversion sub-circuit through the switching sub-circuit. The sense signal may include pixel characteristic values of the pixel unit. The analog-to-digital conversion sub-circuit may convert the received sense signal into a digital signal and then output the digital signal to the external compensation circuit, such that the external compensation circuit reliably compensates a data signal according to the received sense signal. In addition, in the signal output phase, the potential of the first control signal and the potential of the second control signal provided by the external compensation circuit may both be the second potentials; and the switching sub-circuit may control the sense line to be disconnected with the reference power terminal under the control of the first control signal, and may control the sense line to be disconnected with the reference power terminal under the control of the second control signal.

It should be noted that after step 601 is executed, step 604 is executed directly. The sense signal output by the sense line to the analog-to-digital conversion sub-circuit through the switching sub-circuit may be a reference power signal. In this case, when the analog-to-digital conversion sub-circuit converts the reference power signal into a digital signal and outputs the digital signal to the external compensation circuit, such that the external compensation circuit determines a conversion performance of the analog-to-digital conversion sub-circuit according to the received sense signal, and further reliably compensates the data signal according to the conversion performance of the analog-to-digital conversion sub-circuit. This function may also be referred to as a correction function for the analog-to-digital conversion sub-circuit.

In summary, embodiments of the present disclosure provides a driving method of the detection circuit. Since the switch sub-circuit can control on-off states between the sense line and the reference power terminal, the reset power terminal and the analog-to-digital conversion sub-circuit according to the control signals provided by the external compensation circuit, the detection circuit has relatively rich functions.

When the switching sub-circuit sequentially controls the sense line and the reference power terminal as well as the sense line to be in conduction with the analog-to-digital conversion sub-circuit, the sense line may output the reference power signal to the analog-to-digital conversion sub-circuit through the switching sub-circuit, and correspondingly, the sense signal received by the analog-to-digital conversion sub-circuit may be the reference power signal. In this case, after the analog-to-digital conversion sub-circuit converts the sense signal into a digital signal and outputs the digital signal to the external compensation circuit, the external compensation circuit determines a conversion performance of the analog-to-digital conversion sub-circuit according to the conversion result, and reliably compensates the data signal according to the conversion performance, thereby achieving reliable compensation for the conversion performance of the analog-to-digital conversion sub-circuit.

When the switching sub-circuit sequentially controls the sense line and the reference power terminal, the reset power terminal to be in conduction with the analog-to-digital conversion sub-circuit, the sense line may output pixel characteristic values to the analog-to-digital conversion sub-circuit through the switching sub-circuit, and correspondingly, the sense signal received by the analog-to-digital conversion sub-circuit may include the pixel characteristic values. In this case, after the analog-to-digital conversion sub-circuit converts the sense signal into a digital signal and then output the digital signal to the external compensation circuit, the external compensation circuit reliably compensates a data signal output to the pixel unit according to the received sense signal, thereby achieving reliable compensation for the pixel characteristic values. The detection circuit has relatively rich functions and ensures that external compensation circuit has a relatively high compensation accuracy.

As an optional implementation, a driving principle of the detection circuit provided by this embodiment of the present disclosure will be described in detail by taking a pixel unit shown in FIG. 1, the detection circuit shown in FIG. 4, the reset power terminal RST being a ground terminal, and the first potential being a high potential relative to the second potential as examples. As can be seen with reference to FIG. 4, the switching sub-circuit 101 may include a first switch K1, a second switch K2, a third switch K3, and a storage capacitor C1. The analog-to-digital conversion sub-circuit 102 may include an analog-to-digital converter ADC.

Figure 7:
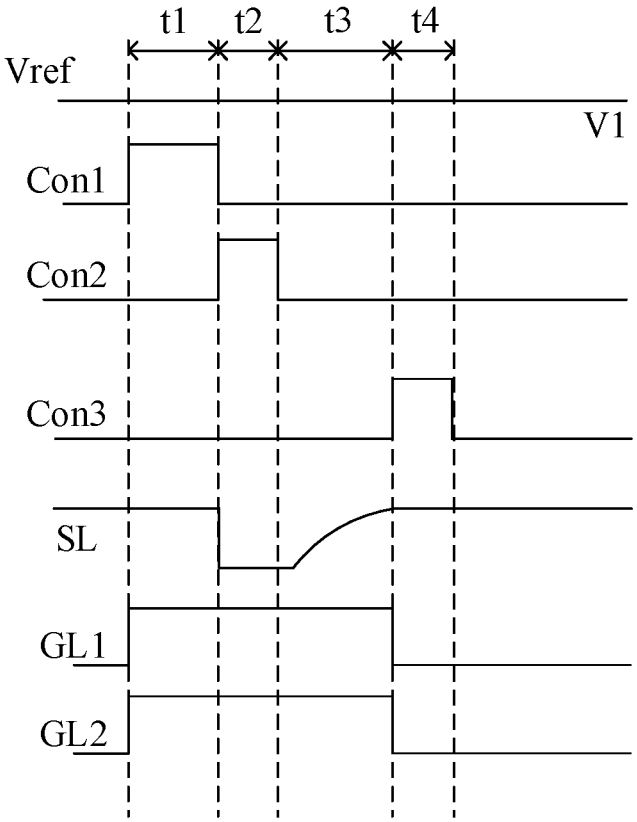
FIG. 7 is a timing diagram of a signal end of a detection circuit provided by an embodiment of the present disclosure.

FIG. 7 is a timing diagram of a signal end of a detection circuit provided by an embodiment of the present disclosure. As shown in FIG. 7, in a charging phase t1, a potential of the first control signal Con1 is a first potential, and a potential of a second control signal Con2 and a potential of the third control signal Con3 are both second potentials. The first switch K1 is turned on, the second switch K2 and the third switch K3 are turned off, and a reference power terminal Vref may output a reference power signal from the reference power terminal Vref to a sense line SL through the first switch K1, thereby charging the sense line SL.

In addition, as can be seen from FIG. 7, a potential of the reference power signal may be V1, and the potential V1 may keep a potential of the sense line SL stable, that is, the potential on the sense line SL may be V1. It should be noted that, in order to ensure sufficient charging of the sense line SL, the duration of the charging phase t1 may be relatively long.

In a resetting phase t2, the potential of the first control signal Con1 and the potential of the third control signal Con3 are both the second potentials, the potential of the second control signal Con2 is a first potential, the second switch K2 is turned on, and the first switch K1 and the third switch K3 are turned off. A reset power terminal RST outputs a reset power signal from the reset power terminal RST to the sense line SL through the second switch K2. A potential of the reset power signal may be the second potential, so as to realize the reset of the sense line SL, release charges stored on the sense line SL, and prepare for the next phase of signal acquisition.

In a signal acquisition phase t3, the potential of the first control signal Con1, the potential of the second control signal Con2, and the potential of the third control signal Con3 are all the second potentials, and the first switch K1, the second switch K2, and the third switch K3 are all turned off. The sense line SL is disconnected with the reference power terminal Vref, the reset power terminal RST, and the analog-to-digital conversion sub-circuit 102, such that the detection circuit 10 achieves a floating function for the sense line SL.

In this case, under the control of a pixel unit, a current will flow through the sense line SL, so that the potential on the sense line SL gradually rises. For example, referring to FIG. 7, the potential on the sense line SL may rise in a curve. Alternatively, referring to FIG. 8, the potential on the sense line SL may rise in a straight line. Since the pixel characteristic values of the pixel unit may change at different times, the potential on this sense line SL can reflect the changes in the pixel characteristic values, such that the external compensation circuit reliably compensates a data signal according to the sense signal from the sense line SL, thereby avoiding the problem of a relatively poor display effect caused by the changes in pixel characteristic values (such as the aging of a driving transistor).

In a signal output phase t4, the potential of the first control signal Con1 and the potential of the second control signal Con2 are both the second potentials, and the potential of the third control signal Con3 is a first potential. The third switch K3 is turned on, and the first switch K1 and the second switch K2 are turned off. The sense line SL may output a sense signal to the analog-to-digital converter ADC through the third switch K3, and a storage capacitor C1 may store the sense signal. In addition, C1 may be much smaller than a parasitic capacitance Cs1 of the sense line SL, thereby ensuring that the sense signal may be kept basically unchanged when it is transmitted to the analog-to-digital converter ADC. Next, the analog-to-digital converter ADC may convert the acquired sense signal into a digital signal and then output the digital signal to the external compensation circuit 01, so that the external compensation circuit 01 reliably compensates a data signal according to the sense signal.

Figure 8:
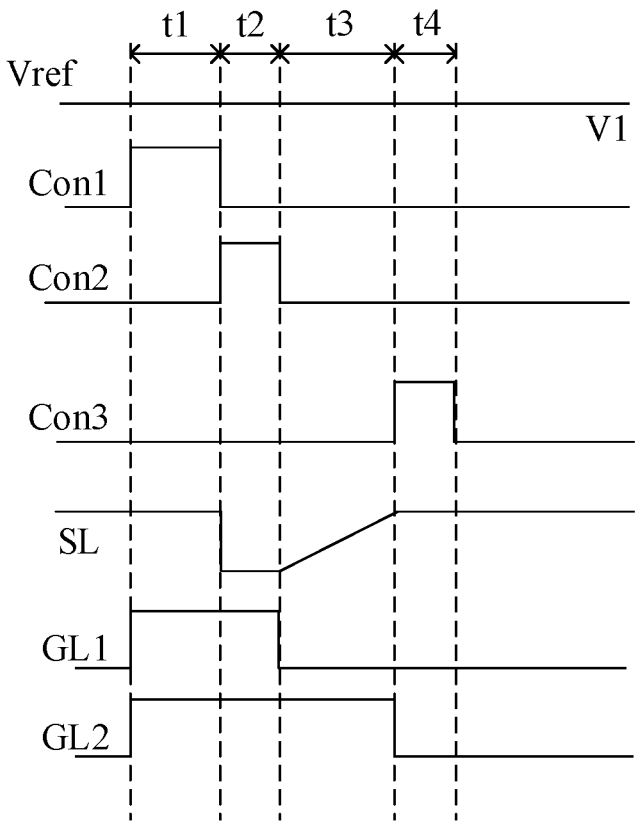
FIG. 8 is a timing diagram of a signal end of another detection circuit provided by an embodiment of the present disclosure.

Optionally, referring to FIGS. 7 and 8, during the charging phase t1 to the signal acquisition phase t3, a potential of a gate drive signal provided by a gate line GL2 may be maintained at the first potential, such that a detection transistor O1 and a switching transistor M1 are turned on. In this case, the reference power signal and the reset power signal output to the sense line SL may be output to a second pole of a driving transistor T1 through the detection transistor O1. Further, a potential Vs of the second pole of the driving transistor T1 is a fixed value. When a gate-source potential difference Vgs of the driving transistor T1 is greater than or equal to a threshold voltage Vth of the driving transistor T1, the driving transistor T1 may be normally turned on to drive a light emitting element L1 to emit light. Therefore, by controlling the potential Vs of the second pole of the driving transistor T1 to a fixed value, the external compensation circuit can reliably adjust the potential of the data signal according to the predetermined threshold voltage Vth of the driving transistor T1, thereby reliably adjusting a gate potential Vg of the driving transistor T.

It should be noted that, referring to FIG. 7, in order to reliably acquire the threshold voltage Vth of the driving transistor T1 through the sense line SL, a potential of the gate drive signal provided by the gate line GL1 may be maintained at the first potential during the charging phase t1 to the signal acquisition phase t3. Correspondingly, the switching transistor M1 may be kept on all the time. Furthermore, the data line DL may continuously provide a data signal of a fixed potential to a gate electrode of the driving transistor T1 through the switching transistor M1. In addition, since the sense line SL is disconnected with the reference power terminal Vref, the reset power terminal RST, and the analog-to-digital conversion sub-circuit 102 in the signal acquisition phase t3, a DC power terminal ELVDD may charge a source electrode of the driving transistor T1, so that a source potential Vs of the driving transistor T1 changes, and then the gate-source voltage difference Vgs of the driving transistor T1 changes continuously. Thus, the sense line SL may determine the threshold voltage Vth of the driving transistor T1 according to the acquired source potential Vs of the driving transistor T1. In the signal acquisition phase t3 shown in FIG. 7, the potential change on the sense line SL may be used to indicate a change in the acquired source potential Vs of the driving transistor T1.

Referring to FIG. 8, in order to reliably acquire an offset rate of the driving transistor T1 through the sense line SL, the potential of the gate drive signal provided by the gate line GL1 may be the first potential during the charging phase t1 and the resetting phase t2, while the potential of the gate drive signal provided by the gate line GL1 may be the second potential after the resetting period t2. Correspondingly, the switching transistor M1 may be turned off in advance before the signal acquisition phase t3. Furthermore, in the signal acquisition phase t3, the data line DL cannot provide a data signal to the gate electrode of the driving transistor T1 through the switching transistor M1. Under a coupling effect of the storage capacitor C0, the amount of change in the gate potential of the driving transistor T1 may be the same as the amount of change in the source potential of the driving transistor T1. That is, the gate-source voltage difference Vgs of the driving transistor T1 can be kept constant. Thus, the sense line SL may determine an offset rate of the driving transistor T1 according to the acquired source potential Vs of the driving transistor T1. In the signal acquisition phase t3 shown in FIG. 8, the potential change on the sense line SL may be used to indicate a change in the acquired source potential Vs of the driving transistor T1.

Figure 9:
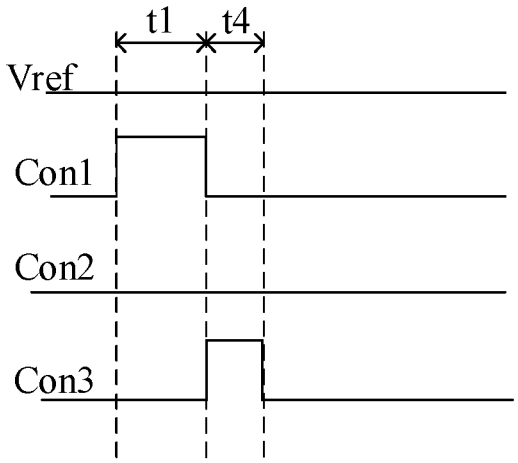
FIG. 9 is a timing diagram of a signal end of yet another detection circuit provided by an embodiment of the present disclosure.

Optionally, FIG. 9 shows a timing diagram of each signal end of the detection circuit 10 when the correction function is performed for the analog-to-digital conversion sub-circuit. As shown in FIG. 9, after the above charging phase t1 is performed, the above signal output phase t4 may be performed directly. The specific driving principle of the signal output phase t4 may refer to the above description.

After the signal output phase t4 is performed, the sense line SL may output a reference power signal as a sense signal to the analog-to-digital converter. The analog-to-digital converter may convert the reference power signal into a digital signal and output the digital signal to the external compensation circuit. Therefore, the external compensation circuit determines a conversion performance of the analog-to-digital converter according to the conversion result of the analog-to-digital converter, and performs targeted and reliable compensation on a data signal according to the determined conversion performance of the analog-to-digital converter, thereby achieving a correction function for the analog-to-digital converter.

It should be noted that, for the timing diagrams of FIG. 7 and FIG. 9, the potentials of the reference power signals provided by the reference power terminal Vref may be different or the same.

As another optional implementation, a driving principle of the detection circuit provided by this embodiment of the present disclosure will be described in detail by taking a pixel unit shown in FIG. 1, the detection circuit shown in FIG. 5, the reset power terminal RST being a ground terminal, and the first potential being a high potential relative to the second potential as examples. As can be seen with reference to FIG. 5, the switching sub-circuit 101 may include two first switches K1, a second switch K2, a third switch K3, and a storage capacitor C1. The analog-to-digital conversion sub-circuit 102 may include an analog-to-digital converter ADC. The reference power terminal Vref includes a first sub reference power terminal Vref1 and a second sub reference power terminal Vref2. The first control signal Con may include a first sub control signal Con11 and a second sub control signal Con12.

Figure 10:
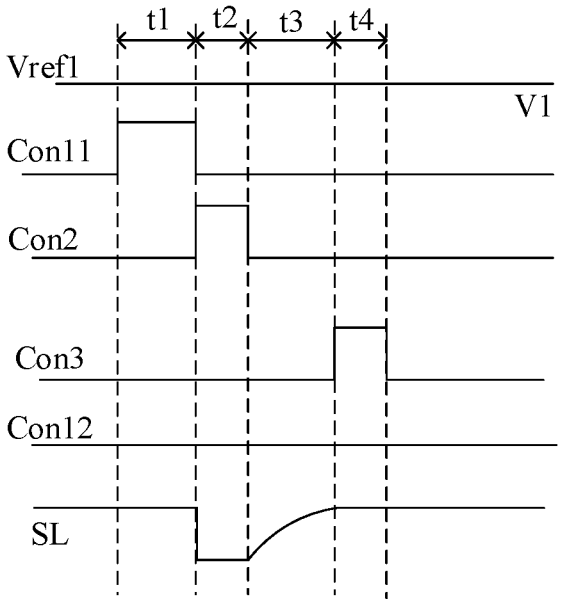
FIG. 10 is a timing diagram of a signal end of still another detection circuit provided by an embodiment of the present disclosure.

FIG. 10 is a timing diagram of a signal end of a detection circuit provided by an embodiment of the present disclosure. As shown in FIG. 10, in a charging phase t1, a potential of a first sub control signal Con11 is a first potential, and a potential of a second sub control signal Con12, a potential of a second control signal Con2 and a potential of the third control signal Con3 are all second potentials. In two of the first switches K1, one first switch K1 controlled by the first sub control signal Con11 is turned on, and the second switch K2 and the third switch K3 are turned off. The sub reference power terminal (such as the first sub reference power terminal Vref1) connected to the turned-on first switch K1 may provide a reference power signal to a sense line SL through this first switch K1, thereby charging the sense line SL. In addition, as can be seen from FIG. 9, the potential of the sub reference power signal may be V1, and the potential V1 may keep the potential of the sense line SL stable, that is, the potential on the sense line SL may be kept at V1.

In a resetting phase t2, the potential of the first control signal and the potential of the third control signal are both the second potentials, the potential of the second control signal is a first potential, the second switch K2 is turned on, and the first switch K1 and the third switch K3 are turned off. A reset power terminal RST outputs a reset power signal from the reset power terminal RST to the sense line SL through the second switch K2, so as to realize the reset of the sense line SL.

In a signal acquisition phase t3, the potential of the first control signal, the potential of the second control signal, and the potential of the third control signal are all the second potentials, and the first switch K1, the second switch K2, and the third switch K3 are all turned off. The sense line SL is disconnected with the first sub reference power terminal Vref1, the second sub reference power terminal Vref2, the reset power terminal RST, and the analog-to-digital conversion sub-circuit 102. That is, the detection circuit 10 may enter the floating function. In this case, under the control of the pixel units, a current will flow through the sense line SL. Referring to FIG. 10, the potential on the sense line SL may rise gradually, and the potential on the sense line SL may rise in a curve.

In a signal output phase t4, the potential of the first control signal and the potential of the second control signal are both the second potentials, and the potential of the third control signal is a first potential. The third switch K3 is turned on, and two of the first switches K1 and the second switch K2 are turned off. The sense line SL may output a sense signal to the analog-to-digital converter ADC through the third switch K3, and a storage capacitor C1 may store the sense signal. In addition, C1 may be smaller than Cs1. Next, the analog-to-digital converter ADC may convert the acquired sense signal into a digital signal and then output the digital signal to the external compensation circuit 01, so that the external compensation circuit reliably compensates a data signal according to the sense signal.

Figure 11:
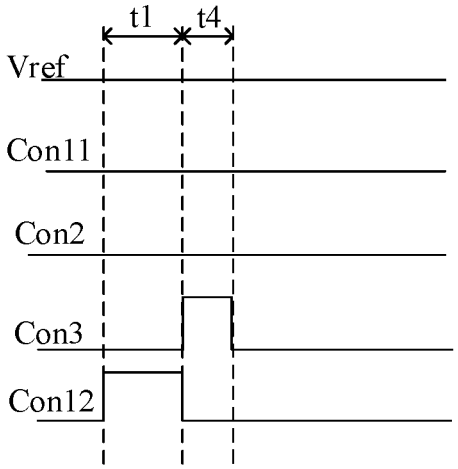
FIG. 11 is a timing diagram of a signal end of still another detection circuit provided by an embodiment of the present disclosure.

Optionally, FIG. 11 shows a timing diagram of each signal end of the detection circuit 10 when the correction function is achieved for the analog-to-digital conversion sub-circuit. As shown in FIG. 11, after the above charging phase t1 is performed, the above signal output phase t4 may be performed directly. The specific driving principle of the signal output phase t4 may refer to the above description.

It should be noted that when the correction function is achieved for the analog-to-digital converter, referring to FIG. 11, during the charging phase t1, the potential of the first sub control signal Con11 may be the second potential, and the potential of the second sub control signal Con12 is a first potential. That is, the first switch K1 connected to another sub reference power terminal (such as the second sub reference power terminal Vref2) may be turned on. That is, when different functions are achieved, different first switches K1 may be controlled, thereby prolonging the service life of each first switch K1.

In summary, embodiments of the present disclosure provides a driving method of the detection circuit. Since the switch sub-circuit can control the on-off states between the sense line SL and the reference power terminal, the reset power terminal and the analog-to-digital conversion sub-circuit according to the control signals provided by the external compensation circuit, the detection circuit has relatively rich functions.

When the switching sub-circuit sequentially controls the sense line and the reference power terminal as well as the sense line to be in conduction with the analog-to-digital conversion sub-circuit, the sense line may output a reference power signal to the analog-to-digital conversion sub-circuit through the switching sub-circuit, and correspondingly, the sense signal received by the analog-to-digital conversion sub-circuit may be the reference power signal. In this case, after the analog-to-digital conversion sub-circuit converts the sense signal into a digital signal and outputs the digital signal to the external compensation circuit, the external compensation circuit determines a conversion performance of the analog-to-digital conversion sub-circuit according to the conversion result, and reliably compensates the data signal according to the conversion performance, thereby achieving reliable compensation for the conversion performance of the analog-to-digital conversion sub-circuit.

When the switching sub-circuit sequentially controls the sense line and the reference power terminal, the reset power terminal to be in conduction with the analog-to-digital conversion sub-circuit, the sense line may output pixel characteristic values to the analog-to-digital conversion sub-circuit through the switching sub-circuit, and correspondingly, the sense signal received by the analog-to-digital conversion sub-circuit may include the pixel characteristic values. In this case, after the analog-to-digital conversion sub-circuit converts the sense signal into a digital signal and then output the digital signal to the external compensation circuit, the external compensation circuit reliably compensates a data signal output to the pixel unit according to the received sense signal, thereby achieving reliable compensation for the pixel characteristic values. The detection circuit has relatively rich functions and ensures that the external compensation circuit has a relatively high compensation accuracy.

Figure 12:
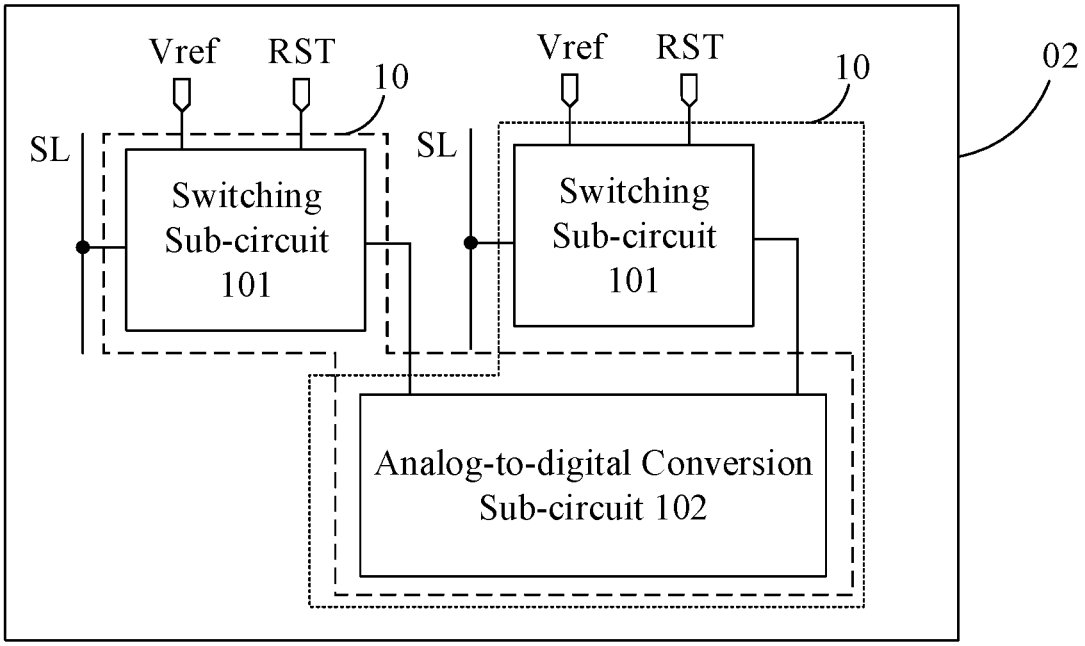
FIG. 12 is a schematic structural diagram of a source driving circuit provided by an embodiment of the present disclosure.

FIG. 12 is a schematic structural diagram of a source driving circuit provided by an embodiment of the present disclosure. As shown in FIG. 12, the source driving circuit 02 may include the detection circuit 10 as shown in any of FIGS. 2 to 5 described above.

Optionally, the source driving circuit may include a plurality of detection circuits 10, wherein at least two of the plurality of detection circuits 10 may multiplex one analog-to-digital conversion sub-circuit 102.

Exemplarily, referring to FIG. 12, the source driving circuit 02 includes two detection circuits 10 in total, and the two detection circuits 10 multiplex one analog-to-digital conversion sub-circuit 102 in total. That is, referring to FIG. 12, the switching sub-circuits 101 included in the two detection circuits 10 are connected to the same analog-to-digital conversion sub-circuit 102 respectively.

It should be noted that, it is assumed that the plurality of detection circuits 10 is divided into a plurality of groups, each group including at least two detection circuits 10. Each group of detection circuits may multiplex the same analog-to-digital conversion sub-circuit 102, and the detection circuits in different groups may multiplex different analog-to-digital conversion sub-circuits 102. Alternatively, the detection circuits in different groups may multiplex the same analog-to-digital conversion sub-circuit 102.

Since the analog-to-digital conversion sub-circuit 102 is only used to achieve the function of converting an analog signal into a digital signal, and each switch sub-circuit 101 may be controlled independently, the structure of the source driving circuit can be simplified in the case of ensuring the compensation effect by multiplexing one analog-to-digital conversion sub-circuit 102.

It should be noted that the detection circuit 10 may be integrated in the source driving circuit, or may be provided independently of the source driving circuit, and connected to the source driving circuit through a signal line.

Figure 13:
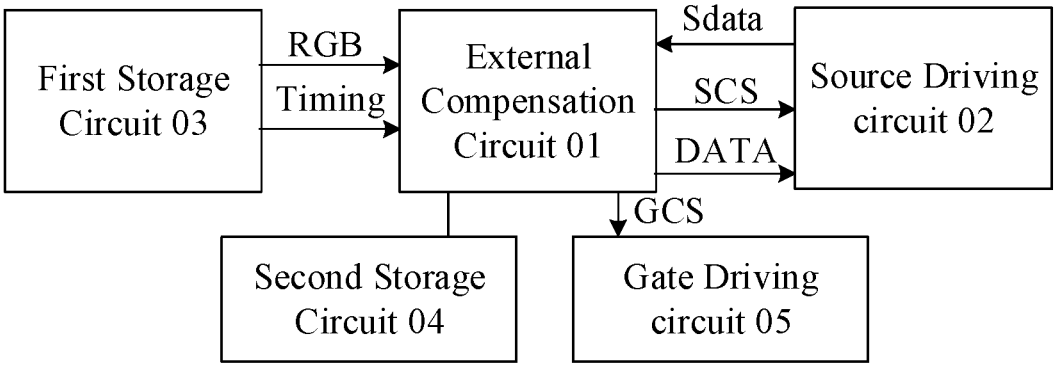
FIG. 13 is a schematic structural diagram of a display apparatus for a display panel provided by an embodiment of the present disclosure.

FIG. 13 is a schematic structural diagram of a display apparatus for a display panel provided by an embodiment of the present disclosure. As shown in FIG. 13, the driving apparatus may include an external compensation circuit 01, and a source driving circuit 02 connected to the external compensation circuit 01 as described in the above aspect.

The source driving circuit 02 may output a sense signal (Sdata) sensed through a sense line to an external compensation circuit 01. The external compensation circuit 01 may compensate a data signal according to the sense signal, and may output the compensated data signal DATA to the source driving circuit 02. The source driving circuit 02 may further be used to output the compensated data signal to a pixel unit through a data line.

Figure 14:
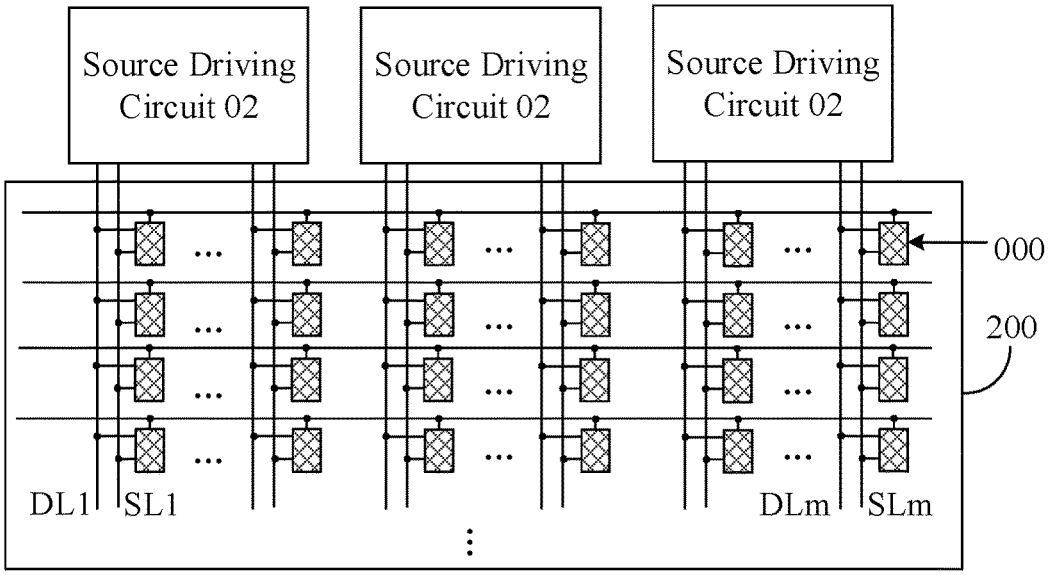
FIG. 14 is a schematic structural diagram of a display apparatus for another display panel provided by an embodiment of the present disclosure.

Optionally, FIG. 14 is a schematic structural diagram of a display apparatus of another display panel provided by an embodiment of the present disclosure. As shown in FIG. 14, the driving apparatus may include a plurality of source driving circuits 02 (FIG. 14 only shows three source driving circuits 02). In addition, referring to FIG. 14, it can be seen that the data line DL and the sense line SL, which are connected to each source driving circuit 02, may be different respectively.

Optionally, referring to FIG. 13, the driving apparatus may further include a first storage circuit 03 and a second storage circuit 04. The first storage circuit 03 and the second storage circuit 04 may be connected to the external compensation circuit 01 respectively.

The first storage circuit 03 may be used to provide a data signal to the external compensation circuit 01, and the second storage circuit 04 may be used to provide pixel compensation values to the external compensation circuit 01.

The pixel compensation values refer to pixel characteristic values (such as a threshold voltage and an offset rate of a driving transistor) of a pixel unit most recently acquired through the sense line SL. Optionally, if each pixel unit includes three sub-pixel units of red, green, and blue, as shown in FIG. 13, the data signal may be RGB data which refers to a data signal before compensation. Correspondingly, the external compensation circuit 01 may reliably compensate the data signal according to the pixel compensation values and the sense signal. For example, the external compensation circuit 01 may process the pixel compensation values and the sense signal by means of calculation, conversion, compensation and other algorithms.

Optionally, referring to FIG. 13, the first storage circuit 03 may also provide a timing control signal to the external compensation circuit 01. The external compensation circuit 01 may output a source control signal (SCS) to the source driving circuit 02 according to the timing control signal, so that the source driving circuit 02 reliably outputs a data signal to the pixel unit according to the SCS.

Referring to FIG. 13, the driving apparatus may further include a gate driving circuit 05. The gate driving circuit 05 may also be connected to the external compensation circuit 01. The external compensation circuit 01 may also generate a gate control signal (GCS) according to the timing control signal and output the GCS to the gate driving circuit 05. The gate driving circuit 05 may output a gate drive signal to the gate lines GL1 and GL2 according to the GCS.

Figure 15:
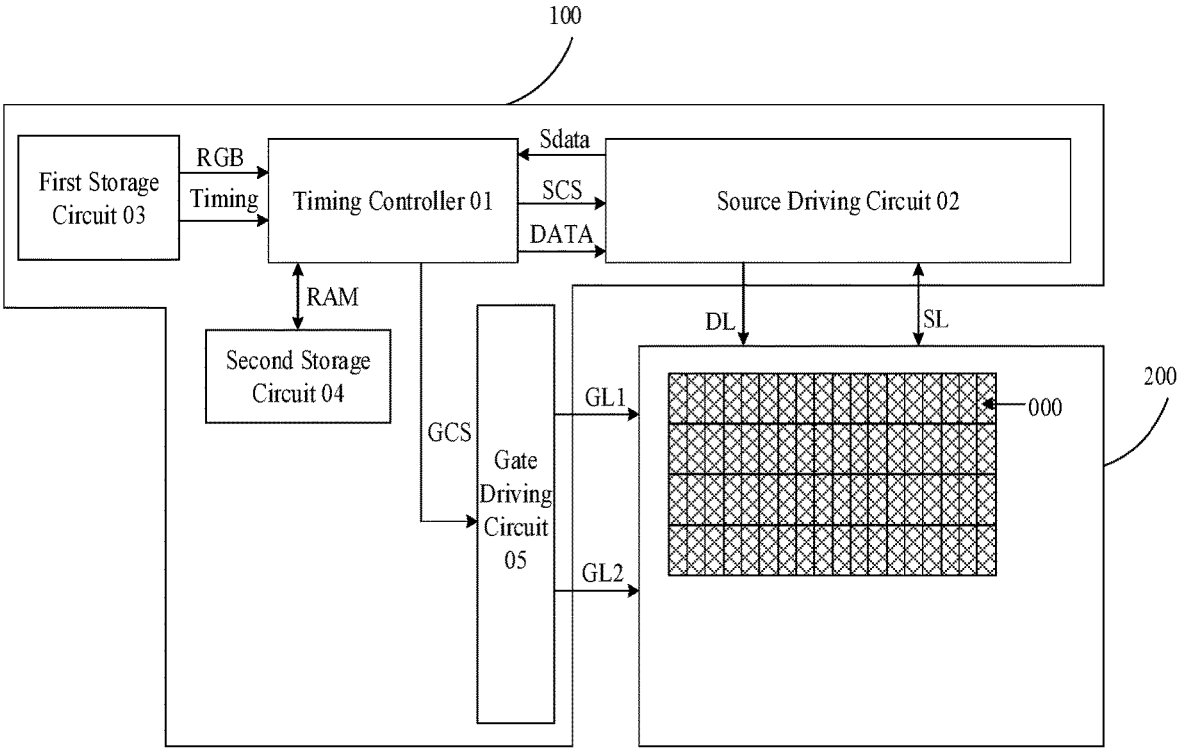
FIG. 15 is a schematic structural diagram of a display apparatus provided by an embodiment of the present disclosure.

FIG. 15 is a schematic structural diagram of a display apparatus provided by an embodiment of the present disclosure. As shown in FIG. 15, the display apparatus may include a display panel 200, and a driving apparatus 100 shown in FIG. 13 or 14.

Referring to FIG. 15, the source driving circuit 02 in the driving apparatus 100 may be connected to a pixel unit 000 in the display panel 200 through the data line DL. The source driving circuit 02 may acquire a sense signal of the pixel unit 000 connected to the sense line SL through the sense line SL, and output a data signal to the pixel unit 000 connected to the data line DL through the data line DL.

Optionally, as can be seen with reference to FIGS. 14 and 15, the display panel 200 may include a plurality of pixel units 000 arranged in an array. The pixel units 000 located in the same column may be connected to one data line DL and one sense line SL, and the data lines DL and sense lines SL connected to the respective pixel units 000 in different columns may be different, respectively. As shown in FIG. 14, a total of m columns of pixel units 000 are shown. The first column of pixel units 000 is connected to the data line DL1 and the sense line SL1, and the last column of pixel units 000 is connected to a data line DLm and a sense line SLm.

Optionally, referring to FIG. 15, the gate driving circuit 04 may be connected to the pixel units 000 in the display panel 200 through the gate lines GL1 and GL2. The gate driving circuit 04 may output a gate drive signal to the pixel units through the gate lines GL1 and GL2. Optionally, the external compensation circuit 01 may be a timing controller (Tcon), or may be a circuit integrated in the Tcon.

Figure 16:
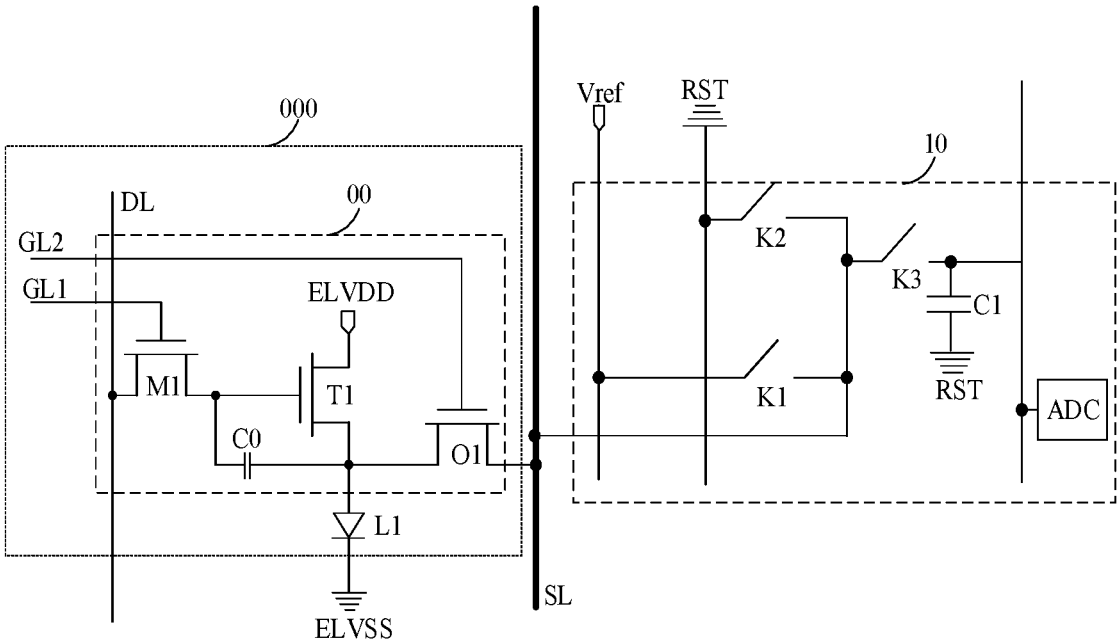
FIG. 16 is a schematic diagram of a connection relationship between a pixel unit and a detection circuit in a display panel provided by an embodiment of the present disclosure.

Optionally, FIG. 16 is a schematic diagram of a connection relationship between pixel units and a detection circuit in a display panel provided by an embodiment of the present disclosure. As shown in FIG. 16, each pixel unit 000 may include a pixel circuit 00, and a light emitting element L1 connected to the pixel circuit 00.

In the embodiment of the present invention, referring to FIG. 16, the sense line SL may be connected to the pixel circuit 00 and the detection circuit 10 in the source driving circuit 02, respectively. The structure of the pixel circuit 00 may refer to the schematic structure diagram of the pixel circuit shown in FIG. 1, and the structure of the detection circuit 10 may refer to the structure schematic diagram of the detection circuit shown in FIG. 4 or FIG. 5. FIG. 16 is described by taking the detection circuit 10 shown in FIG. 4 as an example.

Optionally, the display apparatus may be any product or component having a display function, such as a liquid crystal display panel, an electronic paper, an OLED panel, an AMOLED panel, a mobile phone, a tablet computer, a television, a display, a notebook computer, a digital photo frame, a navigator, or the like.

A person skilled in the art may clearly understand that, for the convenience and brevity of the description, as to the specific working process of the foregoing detection circuit, sub-circuits, assemblies, source driving circuit, driving apparatus and display apparatus, please refer to the corresponding process in the foregoing method embodiment, and details are not described herein again.

The foregoing descriptions are merely optional embodiments of the present disclosure, and are not intended to limit the present disclosure. Within the spirit and principles of the present disclosure, any modifications, equivalent substitutions, improvements, etc., are within the protection scope of the present disclosure.

The invention claimed is:

1. A detection circuit, comprising:

a switching sub-circuit and an analog-to-digital conversion sub-circuit, wherein the switching sub-circuit comprises a first switch assembly, and is connected to a sense line, an external compensation circuit, a reference power terminal, a reset power terminal, and the analog-to-digital conversion sub-circuit, respectively, the switching sub-circuit is configured to control an on-off state between the sense line and the reference power terminal in response to a first control signal provided by the external compensation circuit, control an on-off state between the sense line and the reset power terminal in response to a second control signal provided by the external compensation circuit, and control an on-off state between the sense line and the analog-to-digital conversion sub-circuit in response to a third control signal provided by the external compensation circuit; and the analog-to-digital conversion sub-circuit is also connected to the external compensation circuit, and the analog-to-digital conversion sub-circuit is configured to convert a sense signal from the sense line into a digital signal and output the digital signal to the external compensation circuit when the analog-to-digital conversion sub-circuit is in conduction with the sense line, such that the external compensation circuit compensates a data signal according to the digital signal; the detection circuit further comprises a storage sub-circuit; wherein the storage sub-circuit is connected to the reset power terminal, the switching sub-circuit and the analog-to-digital conversion sub-circuit, respectively, and the storage sub-circuit is configured to store a sense signal output from the sense line to the analog-to-digital conversion sub-circuit through the switching sub-circuit when the sense line is in conduction with the analog-to-digital conversion sub-circuit; and the storage sub-circuit comprises a storage capacitor; and one end of the storage capacitor is connected to the switching sub-circuit and the analog-to-digital conversion sub-circuit, and the other end of the storage capacitor is connected to the reset power terminal; the first switch assembly is connected to the external compensation circuit, the sense line and the reference power terminal, and the first switch assembly is configured to control the on-off state between the sense line and the reference power terminal in response to the first control signal; and the first switch assembly comprises two first switches; a control end of each of the two first switches is connected to the external compensation circuit, a first end of each of the two first switches is connected to the reference power terminal, and a second end of each of the two first switches is connected to the sense line; the reference power terminal comprises a first sub reference power terminal and a second sub reference power terminal; a potential of a reference power signal provided by the first sub reference power terminal is different from a potential of a reference power signal provided by the second sub reference power terminal; and a first end of one of the two first switches is connected to the first sub reference power terminal, and a first end of the other first switch is connected to the second sub reference power terminal.

2. The circuit according to claim 1, wherein the switching sub-circuit further comprises a second switch assembly and a third switch assembly;

the second switch assembly is connected to the external compensation circuit, the sense line and the reset power terminal, respectively, and the second switch assembly is configured to control the on-off state between the sense line and the reset power terminal in response to the second control signal; and the third switch assembly is connected to the external compensation circuit, the sense line and the analog-to-digital conversion sub-circuit, respectively, and the third switch assembly configured to control the on-off state between the sense line and the analog-to-digital conversion sub-circuit in response to the third control signal.

3. The circuit according to claim 2, wherein the second switch assembly comprises a second switch, and the third switch assembly comprises a third switch;

a control end of the second switch is connected to the external compensation circuit, a first end of the second switch is connected to the reset power terminal, and a second end of the second switch is connected to the sense line; and a control end of the third switch is connected to the external compensation circuit, a first end of the third switch is connected to the analog-to-digital conversion sub-circuit, and a second end of the third switch is connected to the sense line.

4. The circuit according to claim 3, wherein the switching sub-circuit comprises one first switch, one second switch and one third switch;

the analog-to-digital conversion sub-circuit comprises an analog-to-digital converter, wherein one end of the analog-to-digital converter is connected to the switching sub-circuit, and the other end of the analog-to-digital converter is connected to the external compensation circuit; and the detection circuit further comprises a storage capacitor, wherein one end of the storage capacitor is connected to the switching sub-circuit and the analog-to-digital conversion sub-circuit, and the other end of the storage capacitor is connected to the reset power terminal.

5. The circuit according to claim 3, wherein the analog-to-digital conversion sub-circuit comprises an analog-to-digital converter; and one end of the analog-to-digital converter is connected to the switching sub-circuit, and the other end of the analog-to-digital converter is connected to the external compensation circuit; the detection circuit further comprises a storage sub-circuit, the storage sub-circuit is connected to the reset power terminal, the switching sub-circuit and the analog-to-digital conversion sub-circuit, respectively, and the storage sub-circuit is configured to store a sense signal output from the sense line to the analog-to-digital conversion sub-circuit through the switching sub-circuit when the sense line is in conduction with the analog-to-digital conversion sub-circuit, the storage sub-circuit comprises a storage capacitor, one end of the storage capacitor is connected to the switching sub-circuit and the analog-to-digital conversion sub-circuit, and the other end of the storage capacitor is connected to the reset power terminal.

6. The circuit according to claim 1, wherein the analog-to-digital conversion sub-circuit comprises an analog-to-digital converter; and one end of the analog-to-digital converter is connected to the switching sub-circuit, and the other end of the analog-to-digital converter is connected to the external compensation circuit.

7. A driving method of the detection circuit according to claim 1, comprising:

in a charging phase, in which a potential of the first control signal provided by the external compensation circuit is a first potential, the switching sub-circuit controls the sense line to be in conduction with the reference power terminal in response to the first control signal; in a resetting phase, in which a potential of the second control signal provided by the external compensation circuit is a first potential, and the switching sub-circuit controls the sense line to be in conduction with the reset power terminal in response to the second control signal; in a signal acquisition phase, in which each of the potential of the first control signal, the potential of the second control signal, and a potential of the third control signal provided by the external compensation circuit is a second potential, the switching sub-circuit controls the sense line to be disconnected with the reference power terminal in response to the first control signal, controls the sense line to be disconnected with the reset power terminal in response to the second control signal, and controls the sense line to be disconnected with the analog-to-digital conversion sub-circuit in response to the third control signal; and in a signal output phase, in which the potential of the third control signal is a first potential, the switching sub-circuit controls the sense line to be conducted with the analog-to-digital conversion sub-circuit in response to the third control signal; and the analog-to-digital conversion sub-circuit converts a sense signal from the sense line into a digital signal and outputs the digital signal to the external compensation circuit, such that the external compensation circuit compensates a data signal according to the digital signal.

8. The method according to claim 7, wherein the switching sub-circuit comprises a first switch, a second switch, a third switch, and a storage capacitor; the analog-to-digital conversion sub-circuit comprises an analog-to-digital converter;

in the charging phase, each of the potential of the second control signal and the potential of the third control signal is a second potential, the first switch is turned on, the second switch and the third switch are turned off, and the reference power terminal outputs a reference power signal from the reference power terminal to the sense line through the first switch;

in the resetting phase, each of the potential of the first control signal and the potential of the third control signal is a second potential, the second switch is turned on, the first switch and the third switch are turned off, and the reset power terminal outputs a reset power signal from the reset power terminal to the sense line through the second switch;

in the signal acquisition phase, the first switch, the second switch and the third switch are turned off, the sense line is disconnected with the reference power terminal, the reset power terminal, and the analog-to-digital conversion sub-circuit, and the sense line acquires a sense signal of a pixel unit to which it is connected; and in the signal output phase, each of the potential of the first control signal and the potential of the second control signal is a second potential; the third switch is turned on, the first switch and the second switch are turned off, the sense line outputs the sense signal to the analog-to-digital converter through the third switch, and the storage capacitor stores the sense signal.

9. A source driving circuit, comprising: the detection circuit according to claim 1.

10. The source driving circuit according to claim 9, comprising a plurality of detection circuits, wherein at least two of the plurality of detection circuits multiplex one analog-to-digital conversion sub-circuit.

11. A driving apparatus for a display panel, comprising an external compensation circuit, and the source driving circuit according to claim 9 connected to the external compensation circuit;

the source driving circuit is configured to output a sense signal acquired by the sense line to the external compensation circuit;

the external compensation circuit is configured to compensate a data signal according to the sense signal, and output the data signal after compensation to the source driving circuit; and the source driving circuit is further configured to output the data signal after compensation to a pixel unit through a data line.

12. The driving apparatus according to claim 11, comprising a plurality of the source driving circuits, different driving circuits are connected to different groups of data lines and sense lines, respectively.

13. The driving apparatus according to claim 11, further comprising a first storage circuit and a second storage circuit which are connected to the external compensation circuit, respectively; the first storage circuit is configured to provide a data signal to the external compensation circuit, and the second storage circuit is configured to provide pixel compensation values to the external compensation circuit; and the external compensation circuit is configured to compensate the data signal according to the pixel compensation values and the sense signal.

14. A display apparatus, comprising a display panel, and the driving apparatus for the display panel according to claim 11, wherein a source driving circuit in the driving apparatus is connected to pixel units in the display panel through data lines and sense lines.

15. The display apparatus according to claim 14, wherein the display panel comprises a plurality of pixel units which are arranged in an array; and each column of pixel units is connected to one data line, different columns of pixel units are connected to different data lines, each column of pixel units is connected to one sense line, and different columns of pixel units are connected to different sense lines.

16. The display apparatus according to claim 15, wherein each of the pixel units comprises a pixel circuit and a light emitting element connected to the pixel circuit; and each sense line is connected to corresponding pixel circuits and a corresponding detection circuit in the source driving circuit, respectively.

17. The display apparatus according to claim 16, wherein the source driving circuit comprises a plurality of detection circuits, and at least two of the plurality of detection circuits multiplex one analog-to-digital conversion sub-circuit;

the driving apparatus comprises a plurality of the source driving circuits, different driving circuits are connected to different groups of data lines and sense lines, respectively; and the driving apparatus further comprises a first storage circuit and a second storage circuit which are connected to the external compensation circuit, respectively; the first storage circuit is configured to provide a data signal to the external compensation circuit, and the second storage circuit is configured to provide pixel compensation values to the external compensation circuit; and the external compensation circuit is configured to compensate the data signal according to the pixel compensation values and the sense signal.

* * * * *